United States Patent [19]

Mathieu

[11] 4,172,485

[45] Oct. 30, 1979

[54] CAMERA CASE

[76] Inventor: Sandra L. Mathieu, 12651 Memorial, Houston, Tex. 77024

[21] Appl. No.: 877,097

[22] Filed: Feb. 13, 1978

[51] Int. Cl.[2] ..... A45C 11/38

[52] U.S. Cl. ..... 150/52 J; 190/44

[58] Field of Search ..... 150/52 J; 354/288, 295; 190/21, 44; 220/4 C, 4 D, 296

[56] References Cited

U.S. PATENT DOCUMENTS

| | | | |
|---|---|---|---|
| 628,888 | 7/1899 | Kirby | 220/4 C |
| 1,434,460 | 11/1922 | Tibbatts | 220/4 C |
| 2,547,492 | 4/1951 | Rohlik | 150/52 J |
| 2,588,611 | 3/1952 | Breen | 220/296 X |
| 2,989,203 | 6/1961 | Bramming | 220/296 X |
| 3,072,166 | 1/1963 | Von Buchholtz | 150/52 J |
| 3,190,373 | 6/1965 | Weathersby | 220/4 C X |
| 3,361,290 | 1/1968 | Matthews | 220/296 |
| 3,728,003 | 4/1973 | Bohannon | 190/44 X |

FOREIGN PATENT DOCUMENTS 1155321 10/1963 Fed. Rep. of Germany.

*Primary Examiner*—Donald F. Norton
*Attorney, Agent, or Firm*—Gunn & Lee

[57] ABSTRACT

An apparatus for enclosing a camera body and camera lens is disclosed. In the illustrated and preferred embodiment, the structure incorporates a generally rectangular case for a camera body. The case is sized to enclose a typical 35 millimeter single lens reflex (SLR) camera body, although it can be sized for other camera types. The camera case incorporates a protruding bayonet-connected or threaded fitting for joinder to a tubular case. The tubular case, having a length to match the length of the lens system for the camera; it may also separately enclose the camera lens. Consequently, the present invention enables a camera case to enclose a camera body and separately or jointly enclose a camera lens where the camera lens has any practical length. Accordingly, the user may switch camera lenses from short to long or the reverse and still have a case which will enclose the camera body with an attached camera lens and further have a means for storage of the separate camera lens after it has been removed from the camera body.

10 Claims, 4 Drawing Figures

CAMERA CASE

BACKGROUND OF THE DISCLOSURE

A camera buff may utilize more than a single lens for a given camera. It appears that many and varied lens systems are readily available for most cameras. Most serious amateur photographers and many professionals utilize a 35 millimeter SLR camera system which incorporates a separable camera body and several selectively connected camera lenses. A lens is herein defined as a removable lens assembly which is releasably affixed to a camera, without or with various filters. Most camera bodies are constructed with an opening for a threaded or bayonet connection to attach a lens to the body. Camera lenses vary markedly in length. They may be short for a wide angle lens system and can be quite long for a telephoto system. A typical lens will vary up to 400 millimeters in length for a telephoto lens for a 35 millimeter SLR camera body. Practically all lenses have the form of an elongate tubular body surrounding very expensive optical wares, and require protection. Protection is necessary to prevent jarring, scratching, or other damage to the apparatus.

The present invention is able to be used with a single camera body and many varied lenses. In a typical circumstance, a camera buff will carry with him a SLR camera, with a first lens attached to the camera body. He will also carry a detached, different lens as a spare or back-up lens. The second lens often will serve different optical goals. Each lens typically has a preferred application, e.g., telephoto or close-up shots. As circumstances arise, the user may swap lenses mounted on the camera body to take optically different photographs through the various lens.

A 35 mm. SLR camera is typically quite expensive. The various lens are also expensive. The camera lenses and body are also susceptible to harm and damage without proper protection. For convenience and protection, most users prefer to carry their 35 mm. SLR camera in a case on a strap around the neck or over the shoulder. This convenience is valuable, but it is also accompanied by some risk. Consequently, the user normally prefers a storage mechanism whereby the camera can be easily obtained for use and protected when not in use. In the event that a lens is changed, there is a necessity for storing the removed lens. The present invention serves just that very purpose, namely, protecting the lenses and camera body, both singly and when connected together.

The camera case of the present invention enables a user to store the camera body and a selected lens detachably affixed to the body as a unit. An alternate lens can be separately stored, and the two lenses can be swapped as desired. The case of the present invention accommodates variations in size, length and weight of alternate lens systems. Moreover, each separable component including the camera body and each lens is protected while stored. The storage device is flexible to store and protect lenses of all lengths.

BRIEF DESCRIPTION OF THE DISCLOSED EMBODIMENT

The embodiment of the present invention is a camera case for a camera body affixed to differing lenses which have variable lengths. The present invention is a camera case including a case portion which encloses the camera body and which has an opening therein adapted to be connected to a tubular attachment having variable lengths. The attachment is sized to enclose the selected lens. Moreover, the tubular extension which encloses the lens can be selectively removed and replaced with an alternate length. This adjustment enables lenses of different lengths or optical characteristics to be swapped and yet stored safely in the field. A cap or lid closes over the end of the tubular extension to enclose the lens in it.

DETAILED DESCRIPTION OF THE DISCLOSED EMBODIMENT

Figure 1:
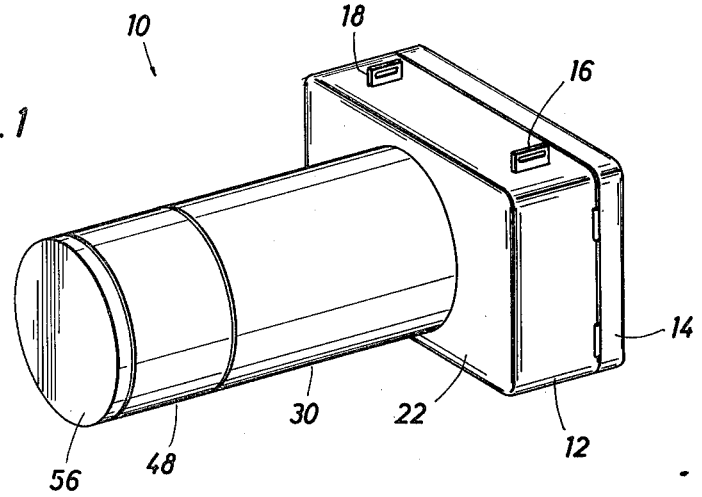
FIG. 1 is a perspective view showing the camera case of the present invention for enclosing a camera body and lens.

In the drawings, FIG. 1 discloses a camera case which is identified by the numeral 10. The present invention is intended for use and is described in its preferred embodiment cooperative with a SLR camera body and separable lens. The lens will typically be in the range of about 45 mm. to 70 mm. in width and can range up to 400 mm. in length. The dimensions which are quoted herein are practical and are found in 35 mm. lens presently in use. The present invention can be adapted to other dimensions as desired. It will be further noted that in most SLR cameras the camera body is separate from the lens. The camera body has an opening where the lens is affixed. The lens is typically affixed to the body with either a threaded or bayonet type connection. The opening for the lens system is typically not centered. The present invention can accommodate this by simply constructing the camera case 10 in conformance with the general profile of the camera to be stored. Further, the present invention functions very well with lenses, thin light filters, reflective shields, and other attached accessories on the lens or body. These items can be stored with the camera if desired. They do not detract from use of the camera case which is disclosed herein or prevent its use and operation.

In FIG. 1, the numeral 12 identifies a camera case for the camera body proper. The body, itself, is placed in the case 12. The case 12 is generally rectangular, and it has a removable back portion 14. The shape and dimensions among many popular SLR cameras are similar, but they are not uniform due to an absence of industry standards. The back portion 14 can be removed or hinged, as the case may be. It can be affixed by any suitable means, including snaps (not shown), a zipper, clamps and so on. The body 12 is rigid or at least semi-rigid. By semi-rigid, reference is made to camera cases which have some yield or give in them such as those which are made of leather or vinyl products. They have adequate give so that they are not quite rigid; on the other hand, they are sufficiently stiff so that they do not collapse. This gives body to the structure which encloses the camera proper.

The camera case 12 may be lined. A lining may be of any construction. A good lining is obtained through the use of a foam padded material having a covering such as a satin or velveteen finish or the like. Normally, the inside surface covering protects the camera case against scratches, and it typically is free of dust. Typical construction is vinyl plastic of 0.080 inches thickness, about 0.5000 inches foam and a cloth layer.

The camera body fits in the rectangular case fairly snugly. It is held in it with little freedom for sliding movement. This prevents the camera body from rattling in the case. The back 14 is shown to have a rectangular shape. It can also be defined as an angular lid portion so that it exposes the top two corners of the body when opened.

The present invention utilizes strap eyelets 16 and 18 affixed to the camera case 12. They are to receive a shoulder strap, hand strap, or waist belt for the user's convenience. An alternate form of fasteners is clips, rings, loops and the like in lieu of or in addition to the strap eyelets 16 and 18.

The camera case body 12 is generally rectangular, and, on its exposed front face, it has a large, circular opening. This opening is defined by a circular connective fixture 20, better shown in FIG. 2 of the drawings. Several types of connectors can be used. One common type is a threaded connector. An alternate form which finds ready acceptance is a bayonet-type connection where the parts come together or separate with about one-quarter turn of rotation. The connective fixture 20 is circular and hollow. This exposes the camera body proper at the lens opening. The camera body, itself, is normally made with an opening whereby the lens can be connected to the camera body to expose the film. Accordingly, they are all aligned so that the lens affixed to the camera body extends through the circular, open member 20. The member 20 is thus typically formed of metal and has a supported, bottom flange affixed to the flat, upper surface 22 of the camera case. The flange is typically recessed and out of sight so that a good, solid connection is made between the connector 20 and the camera case face 22. An alternate construction is integrally casting of the connector portion with the case itself in plastic. The connector can be either a cast bayonet end fitting or machined threaded hub on the case. This generally requires a more expensive mold for the case parts.

Figure 2:
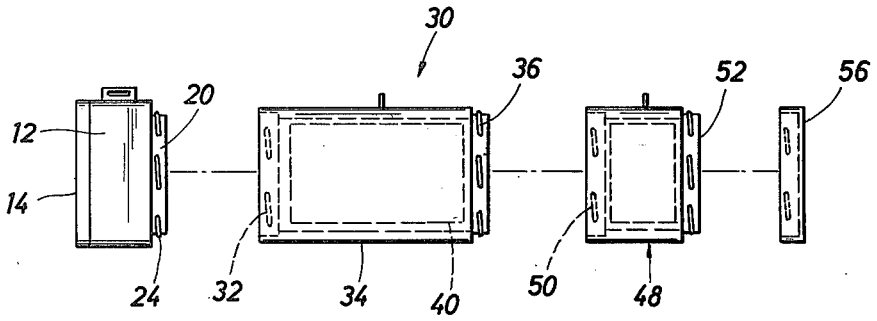
FIG. 2 is an exploded view along the length of the camera case of the present invention for enclosing a camera body, an affixed lens and a spare lens which encloses all of these components safely.

The circular member 20 is equipped with grooves or threads 24 to function as a connector. Various and sundry connector systems are known and can be adapted, including threaded connections and bayonet-type connections. In FIG. 2, it will be noted that a tubular case member 30 is positioned axially and on line with the connector 20. The connector 20 is arranged oppositely of a matching connector 32. They are brought together or separated so that the cases 12 and 30 can be connected or disconnected. The connector 32 is arranged at one end of the tubular, hollow case 30. The case 30 includes an outer body 34 formed of the same general construction as the apparatus described before. That is to say, it includes at least a rigid or semi-rigid construction so that it holds a generally circular cross section, and it has a lining which is soft enough to cushion the lens placed in it. Moreover, it is preferably free of dust.

The tubular extension 30 is fitted with a connector 36. The connector 36 is identical to the connector 20. It is either integrally cast or separately made and attached later. Preferably, they are axially aligned, have the same diameter and have the same connector system. This then defines a hollow body for receiving a lens in it. Such a lens is shown in dotted line at 40 in FIG. 2. The lens is caught between the connectors at the opposite ends of the case body 34. The case body 34 serves as a protective housing for enclosing the lens 40. Moreover, it has a length which slightly exceeds that of the lens.

Lenses are made in certain, commonly specified lengths. A typical maximum is about 400 millimeters. To this end, the case 30 can be constructed and arranged so that it has an internal storage cavity for accommodating a 400 millimeter telephoto lens. Such a cavity will safely receive and nest the telephoto lens in it to provide the ultimate in protection. Conversely, shorter lenses are known, including those having a common dimension of 135 millimeters. The tubular case 30 can be constructed and arranged to receive and store a lens of 135 millimeters length.

The lens case 30 is affixed to the rectangular case 12. When the two are joined together, they serve the intended purpose of enclosing and protecting a camera system, including camera body and attached lens.

FIG. 2 discloses a tubular case 48. It has a left-hand fitting 50 which matches the connector 36. It has a right-hand connector 52. The connectors 50 and 52 are preferably chosen from the same system of connectors previously described. It will be observed that the tubular storage case 48 is identical to the storage case 30, except that it differs in length. It has the same fittings at the respective ends and is preferably constructed of the same type outer wall, padding and inner lining.

The numeral 56 identifies an end closure cap having a set of threads or bayonet connections suitable for connection to the fittings 20, 36 and 52. This permits the end of the storage case to be closed over. The cap 52 can be lined, if desired, with a thin, stain-like cloth and foam lining material of the same sort used in the other components. This provides a protective surface which does not accumulate much dust and which also prevents scratching the endmost lens surface should the cap make contact with it.

When all of the components shown in FIG. 2 are assembled, they accommodate either one long lens or two separate lenses. Consider the latter case. A camera body is placed in the case 12. A first lens (whether or not attached to the camera body) is located in the tubular extension 30. Preferably, sizes are selected such that the specific lens fits within the tubular extension 30. If a second lens is available, and, typically, one is, it is also placed in the assembled case components. This stores two lenses, one after the other.

The two lenses are separately encased by a resilient foam padding affixed to a cap placed on the ends between the two tubular sections. The two sections 30 and 48 are simply connected together by bringing the connectors 36 and 50 together in the intended manner to form a long storage container. Alternately, they can be used separately and covered by the cap 56.

Figure 3:
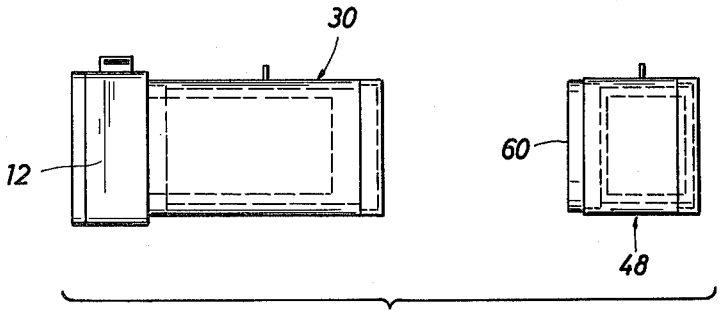
FIG. 3 discloses the present invention for enclosing a camera body and long lens with a spare, shorter lens enclosed in a shorter storage case.
Figure 4:
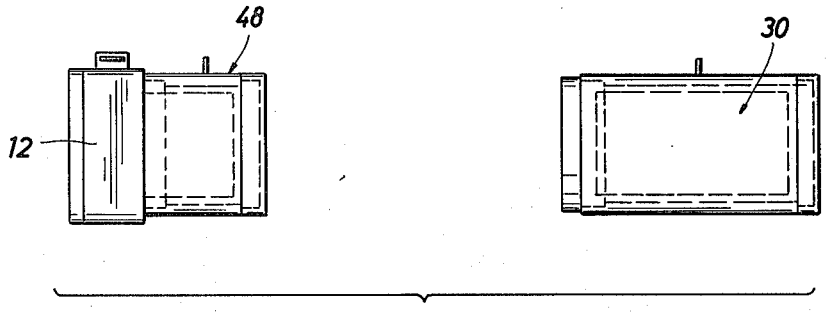
FIG. 4 is a view to be contrasted with FIG. 3 which shows the two lenses of FIG. 3 swapped whereby the shorter lens is affixed to the camera body and the longer lens is in storage.

FIG. 3 should be considered next. There, the camera case 12 is affixed to the tubular extension 30. It is closed over by a cap on the end. This is ideal for storing a given camera body and fairly long lens. Separate and apart, the tubular case 48 stores an alternate lens' and both ends of it are capped. The arrangement of FIG. 3 requires three caps. Two can be constructed identical to the cap 56 previously shown. That is to say, the cap 56 is a female fitting. In addition, a male fitting on a cap is required at 60 to thread to the fitting 50 previously mentioned. It will be further observed in FIG. 3 that the longer of the two tubular cases is affixed to the body case 12, and the shorter is remote. By contrast, FIG. 4 shows the opposite arrangement, namely, an arrangement wherein the camera case 12 is affixed to the shorter, tubular case 48, and the case 30 is separate. This illustrates the versatility of the present invention and, in particular, shows how different lenses can be alternately stored and used. Storage and use, of course, refers to the times at which a given lens is affixed to the camera body proper.

FIGS. 3 and 4, together, jointly show the versatility of the present invention. The versatility is evidenced by the fact that the device can be used to store safely a given camera body with any lens affixed to it. Moreover, an alternate or substitute lens is kept in a ready condition, safely stored in its own container, close or remote, as the case may be. This enables quick installation of a second lens on a camera body. The user simply has to remove an alternate lens from its storage container and place it on the camera body. In the same instance where one is installed, the previously used lens is removed and is stored. If the storage containers are inappropriate in size, a substitution can be made quickly. As an example, the tubular storage cases 30 and 48 can be removed from the body 12 and swapped. The examples set forth utilize only two sizes, but, of course, three or more different case sizes can be used in a given situation.

The foregoing is directed to the preferred embodiment of the present invention, but the scope is determined by the claims which are affixed hereto.

I claim:

1. A case for enclosing a camera body and a camera lens system for use with the camera body which case comprises:

(a) a camera body case having an internal cavity shaped and adapted to receive and support therein a camera body wherein the camera body case substantially encloses and supports the camera body when placed therein to provide protection and storage to the camera body;

(b) a separable lens case which is formed of an elongate, tubular housing having an internal cavity therein for receiving an elongate, tubular lens, there being mating rotary connector means at an opening in said camera body case and at one end of said lens case so that they may be joined selectively together or disjoined from one another and to further cooperate with said camera body case to enclose and support a camera body havng a camera lens system mounted thereon which lens system extends through the opening in said camera body case into said elongate, tubular housing; and (c) wherein the opening is round, and said connector means includes mating and separable connector means which lock together on joinder.

2. The apparatus of claim 1 wherein said connector means form a bayonet-type connection.

3. The apparatus of claim 2 wherein connector means are located at both ends of said elongate, tubular lens case, the connector means at one end being a male and the connector means at the opposite end being a female connector means and the connector means on said body case being either a male or female connector means.

4. The apparatus of claim 3 including a circular cap means formed with a mating male or female connector means thereon for closing over the elongate, tubular housing.

5. The apparatus of claim 4 wherein said cap means incorporates a female connector means thereon.

6. The apparatus of claim 1 including first and second separate lens storage cases which have equal diameters and are right cylinders and which have internal storage cavities of different lengths therein.

7. The apparatus of claim 1 including a quarter turn lock means having separable male and female threaded members which join on rotation of about one quarter turn.

8. A case for enclosing a camera body and a camera lens system for use with the camera body which case comprises:

(a) a camera body case having an internal cavity adapted to receive and support therein a camera body wherein said camera body case encloses and supports the camera body when placed therein;

(b) a separable lens case which is formed of an elongate, tubular housing of right cylindrical construction enclosing an internal cavity therein for receiving an elongate, tubular lens system;

(c) circular opening means in said camera body case matching the location of a camera lens system affixed to the camera body and further enabling a camera lens system to protrude through said opening means when affixed to a camera body; and (d) connector means including mating and separable rotary connector means which lock together on joinder for joinder of said camera body case and said lens case with said lens case aligned with said opening means.

9. The apparatus of claim 8 wherein said connector means affixes said lens case aligned with said opening means and comprises a circular, surrounding, threaded fitting and wherein said lens case comprises a right cylinder having a diameter determined by said opening means.

10. The apparatus of claim 9 including a hinged door means in said camera body case which opens sufficiently wide to permit a camera body to be removed through said door means and which door means divides said camera body case into two portions, one of which includes said opening means, said connector means and said lens case cooperatively assembled as a unit and wherein the camera body is retractable through said door means away from said opening means to withdraw an affixed camera lens system therethrough.

* * * * *